US006222395B1

(12) United States Patent
Bertin et al.

(10) Patent No.: US 6,222,395 B1
(45) Date of Patent: Apr. 24, 2001

(54) SINGLE-ENDED SEMICONDUCTOR RECEIVER WITH BUILT IN THRESHOLD VOLTAGE DIFFERENCE

(75) Inventors: Claude L. Bertin, South Burlington; Russell J. Houghton; William R. Tonti, both of Essex Junction, all of VT (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 09/225,112

(22) Filed: Jan. 4, 1999

(51) Int. Cl.[7] ..... G05F 1/10
(52) U.S. Cl. ..... 327/77; 327/534
(58) Field of Search ..... 327/534, 535, 327/537, 538, 307, 543, 77, 65; 326/31, 34

(56) References Cited

U.S. PATENT DOCUMENTS

| | | | | |
|---|---|---|---|---|
| 4,742,292 | | 5/1988 | Hoffman | 323/314 |
| 4,948,992 | * | 8/1990 | Bukowski, Jr. | 307/491 |
| 5,091,663 | | 2/1992 | Ishizaki et al. | 307/530 |
| 5,221,864 | | 6/1993 | Galbi et al. | 307/296.8 |
| 5,248,946 | | 9/1993 | Murakami et al. | 330/253 |
| 5,278,467 | | 1/1994 | Nedwek | 307/530 |
| 5,384,740 | | 1/1995 | Etoh et al. | 365/189.09 |
| 5,467,052 | | 11/1995 | Tsukada | 327/543 |
| 5,635,869 | | 6/1997 | Ferraiolo et al. | 327/543 |

FOREIGN PATENT DOCUMENTS 02230305 9/1990 (JP) .

OTHER PUBLICATIONS

IBM Technical Disclosure Bulletin, vol. 27 No. 6, pp. 3607–3608, Nov. 1984.*
Patent Abstracts of Japan, Publication No. 08125463, May 1996.*
IBM Technical Disclosure Bulletin, vol. 32, No. 98, Feb. 1990, Silicon Band–Gap Reference Voltage Generators Based on Dual Polysilicon MOS Transistors.

* cited by examiner

*Primary Examiner*—Jung Ho Kim

(57) ABSTRACT

A differential receiver for sensing small input voltage swings by using a built in reference voltage obtained by a difference in threshold voltage between a differential pair of closely spaced transistors. The difference in threshold voltage can be produced by different values of ion implantation of the gates of the transistor pair with the same material, or by dosages using different materials. The difference in threshold voltage can also be obtained by using different transistor channel lengths. The threshold voltages can also be modulated by the control of the transistor substrate voltages using a voltage control substrate means.

1 Claim, 5 Drawing Sheets

SINGLE-ENDED SEMICONDUCTOR RECEIVER WITH BUILT IN THRESHOLD VOLTAGE DIFFERENCE

BACKGROUND OF THE INVENTION

1. Technical Field

The present invention relates to differential receiver circuits and more particularly to a differential receiver circuit for sensing small voltage swings.

2. Background Art

U.S. Pat. No. 5,635,869 issued Jun. 3 1997 to Ferraiolo et al. entitled CURRENT REFERENCE CIRCUIT describes a current reference circuit that uses a pair of transistors having different threshold voltages.

U.S. Pat. No. 5,467,052 issued Nov. 3 1995 to Tsukada entitled REFERENCE POTENTIAL GENERATING CIRCUIT UTILIZING A DIFFERENCE IN THRESHOLD BETWEEN A PAIR OF MOS TRANSISTORS discloses a circuit for generating a reference voltage based on the difference of the threshold voltages.

U.S. Pat. No. 5,384,740 issued Jan. 24, 1995 to Etoh et al. entitled REFERENCE VOLTAGE GENERATOR discloses a voltage generator based on a difference between threshold voltages of MOS transistors.

U.S. Pat. No. 5,278,467 issued Jan. 11, 1994 to Nedwick entitled SELF-BIASING INPUT STAGE FOR HIGH-SPEED LOW-VOLTAGE COMMUNICATION discloses a self-biased differential amplifier level restore input circuit for high speed, low voltage communication.

U.S. Pat. No. 5,248,946 issued Sep. 28, 1993 to Murakami et al. entitled SYMMETRICAL DIFFERENTIAL AMPLIFIER CIRCUIT discloses a symmetrical differential amplifier circuit used as a sense amplifier in a semiconductor memory.

U.S. Pat. No. 5,221,864 issued Jun. 22, 1993 to Galbi et al. entitled STABLE VOLTAGE REFERENCE CIRCUIT WITH HIGH VT DEVICES discloses a voltage reference circuit employing devices having different VTs to produce an output offset from a supply voltage.

U.S. Pat. No. 5,091,663 issued Feb. 25, 1992 to Ishizaki et al. entitled MESFET DIFFERENTIAL AMPLIFIER discloses a MESFET differential amplifier that includes a differential switching stage.

U.S. Pat. No. 4,742,292 issued May 3, 1988 to Hoffman entitled CMOS PRECISION VOLTAGE REFERENCE GENERATOR discloses a circuit wherein a differential voltage set by threshold differences of an FET and an implanted FET device provides a reference voltage.

Japanese patent JP 02-230305 published Sep. 12, 1990 discloses a voltage reference based on the difference of threshold voltages of MOS transistors.

In the IBM Technical Disclosure Bulletin, Vol. 32, No. 98, February 1990 at pages 4 and 5, the publication SILICON BAND-GAP REFERENCE VOLTAGE GENERATORS BASED ON DUAL POLYSILICON MOS TRANSISTORS discloses a circuit for generating a silicon band-gap reference voltage for MOS applications by different threshold voltages of two PMOS devices.

In copending U.S. patent application Ser. No. 09/038,395 a method is disclosed wherein silicon bodies are electrically isolated from one another.

SUMMARY OF THE INVENTION

An object of the present invention is to provide a semiconductor receiver circuit having a built in reference voltage for sensing small input voltage swings.

Another object of the present invention is to provide a semiconductor receiver circuit using the difference in threshold voltages of a differential transistor pair to provide a reference voltage for sensing small input voltage swings.

A further object of the present invention is to provide a semiconductor receiver using threshold voltage difference of two transistors to provide a built in reference voltage for sensing small input voltages wherein the threshold difference is obtained by ion implantation of the gates the transistors.

A still further object of the present invention is to provide a semiconductor receiver using threshold voltage difference of two transistors to provide a built in reference voltage for sensing small input voltages wherein the threshold difference is obtained by using different transistor gate materials.

Still another object of the present invention is to provide a semiconductor receiver using threshold voltage difference of two transistors to provide a built in reference voltage for sensing small input voltages wherein the threshold difference is obtained by using different transistor channel lengths.

Other features, advantages and benefits of the present invention will become apparent in the following description taken in conjunction with the following drawings. It is to be understood that the foregoing general description and the following detailed description are exemplary and explanatory but are not to be restrictive of the invention. The accompanying drawings which are incorporated in and constitute a part of this invention and, together with the description, serve to explain the principles of the invention in general terms. Like numerals refer to like parts throughout the disclosure.

DETAILED DESCRIPTION OF THE INVENTION

Differential receivers are commonly used for sensing small voltage swings. A differential receiver requires the generation of a reference voltage or obtaining a reference voltage generated externally to be provided to every receiver circuit on the integrated circuit chip. Small scale technology using smaller voltage swings require lower voltage levels with tighter controls. The generation of such lower voltage levels and their distribution to all the receivers on the chip is very difficult.

The present invention provides an improved differential receiver using a difference in threshold voltage between a differential pair of closely spaced transistors. The difference in threshold voltages is adjusted by ion implantation of the substrate region of the transistor pair, using different gate dopings of the same material such as silicon, and by using different materials or different transistor channel lengths. Threshold voltages are also modulated by the control of substrate voltages.

Figure 1:
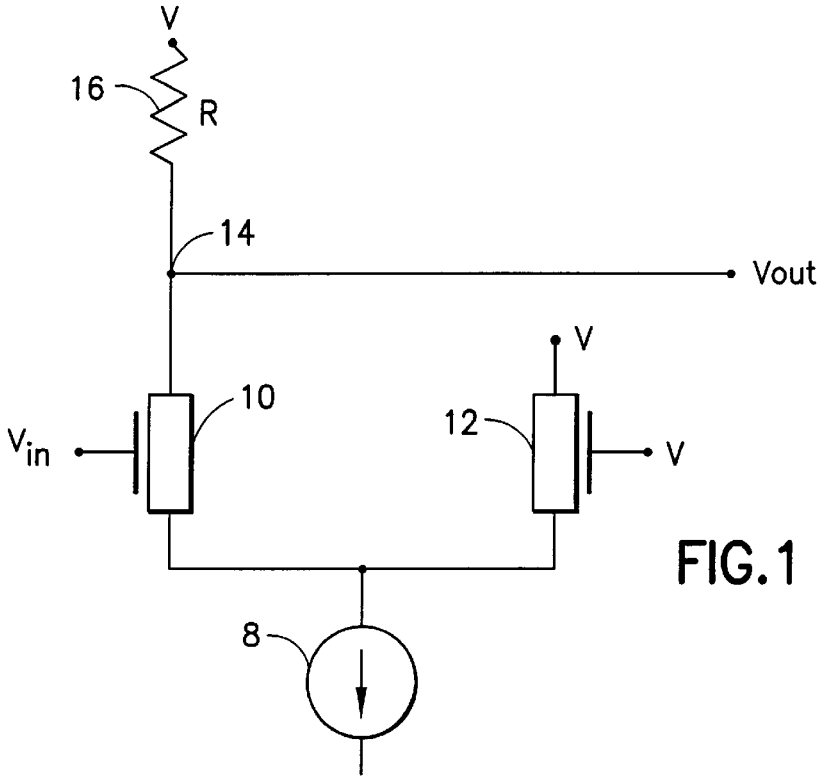
FIG. 1 is a schematic illustration of an embodiment of a receiver circuit according to the principles of the present invention.

FIG. 1 shows an embodiment of a circuit used as a single ended receiver in a static configuration employing a current source 8. A first transistor 10 has its gate connected to voltage Vin and a second transistor 12 is connected to voltage V, however the gate of transistor 12 does not have to be connected to a reference voltage because the receiver of FIG. 1 has a built in reference voltage provided by the difference in threshold voltage between transistor 10 and transistor 12.

Transistors 10 and 12 have a threshold voltages Vt1 and Vt2 respectively, and the difference between Vt1 and Vt2 is used as a built in reference voltage Vref for the incoming voltage signal Vin. In one example of the embodiment shown in FIG. 1, Vt1 is 0.7 volts for transistor 10 and Vt2 is 1.0 volts for transistor 12.

Voltage V is connected to the load resistor 16 of transistor 10 as well as to the gate of transistor 12. Load resistor 16 is connected to transistor 10 at node 14. The output voltage Vout is obtained at node 14 between transistor 10 and resistor 16. Input voltage Vin swings between voltage value V and V—delta V.

Figure 2:
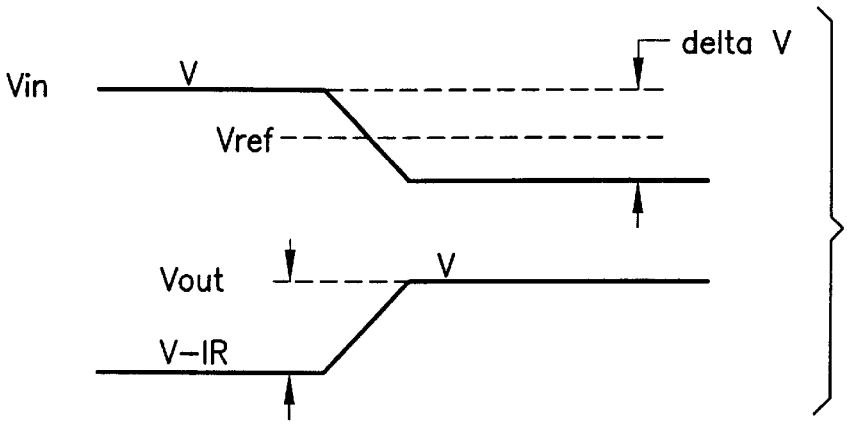
FIG. 2 shows curves illustrating the input and the output voltage swings of the circuit of FIG. 1.

Referring to FIG. 2, the voltage levels of the voltages Vin and Vout for the present example illustrated as well as the voltages V, Vref, and the delta V voltage. The input swing shown in FIG. 2 is between the voltage V and V—delta V. Delta V is twice the Voffset voltage, where Voffset is Vt2 minus Vt1, which in the embodiment of FIG. 1 is 1.0 v−0.7v=0.3v. The output voltage swing is between V and V—IR as shown in FIG. 2.

Figure 3:
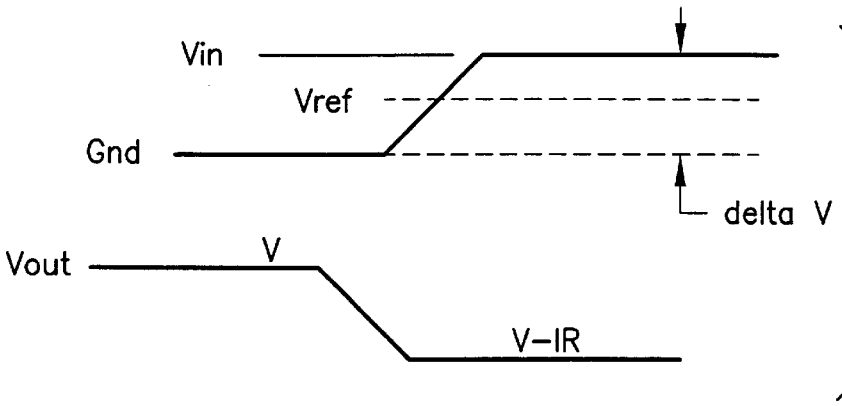
FIG. 3 shows the curves illustrating the input and output voltage swings of the circuit of FIG. 1 for different input voltage conditions.

Referring to FIG. 3, the voltage levels of the voltages Vin and Vout for the present example are illustrated as well as the voltages V, Vref, and the delta V voltage difference between voltage V and voltage Vref for the circuit embodiment shown in FIG. 1 but where the threshold voltage VT1 of the transistor 10 is now 1.0 volts and the threshold voltage Vt2 of transistor 12 is now 0.7 volts. The input swing shown in FIG. 3 is between ground (V=0) and delta V above ground (above V=0). In the embodiment represented in FIG. 3, delta V=0.6 volts, so the input voltage swings between ground and 0.6 volts. The reference voltage is adjusted by the difference in voltage between transistors 10 and 12. Vref=Voffset=Vt1−Vt2=0.3 v. As shown in FIG. 3, the input voltage swings between V and V—IR.

The differences in threshold voltages Vt1 and Vt2 can be obtained in several ways. One method is by ion implantation wherein a block out mask is used such that only one of the two transistors 10 and 12 has an additional implant to change the threshold voltage value. Another method is to implant both transistors 10 and 12 identically and have the same dimensions, but have different gate dopings or be composed of different materials resulting in different thresholds due to work function differences.

The following Table 1 lists examples of different materials:

TABLE 1

| Device 10 Gate | Device 12 Gate | Workfunction Delta |
|---|---|---|
| N+ Poly | P+ Poly | 1.10 volts |
| N+ Poly | Tungsten | 0.45 volts |
| N+ Poly | Aluminum | 0.15 volts |
| Tungsten | Gold | 0.30 volts |

Still another method for achieving threshold differences is to use a difference in channel length (Leff) between devices 10 and 12 near the roll off point of Vt vs. Leff.

Figure 4:
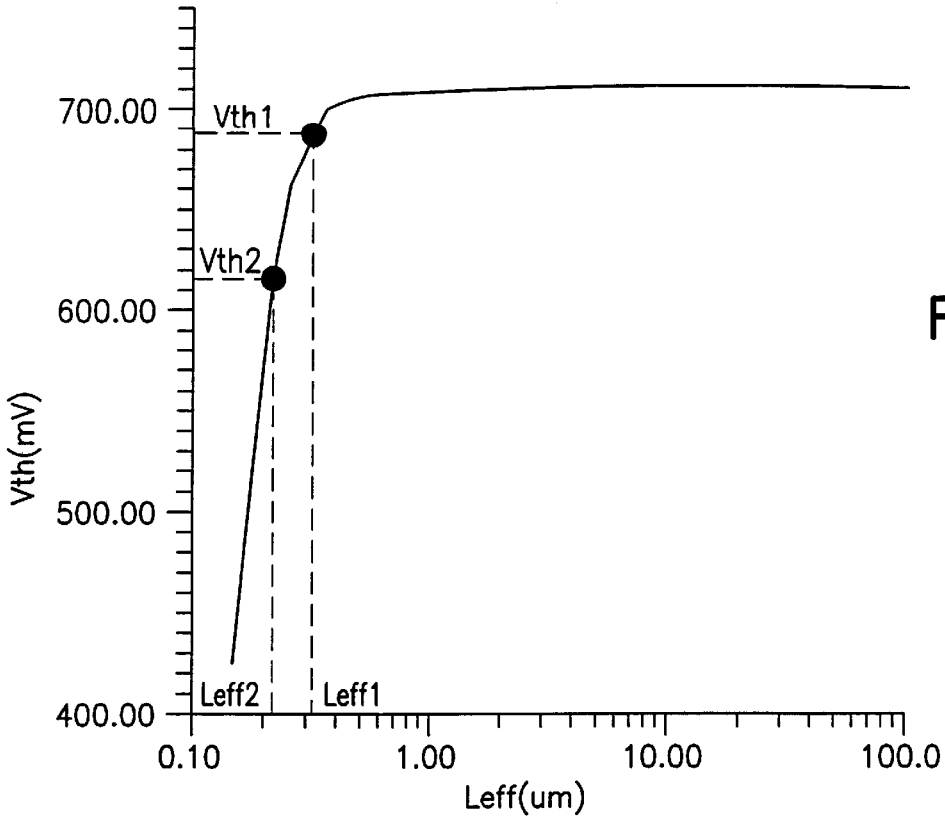
FIG. 4 is a graph illustration showing the relationship between threshold voltage Vth and channel length Leff.

FIG. 4 illustrates the relationship between threshold voltage Vth and channel length Leff. As the channel length is increased from Leff1 to Leff2, the threshold voltage increases from Vth1 to Vth2 as shown.

Figure 5:
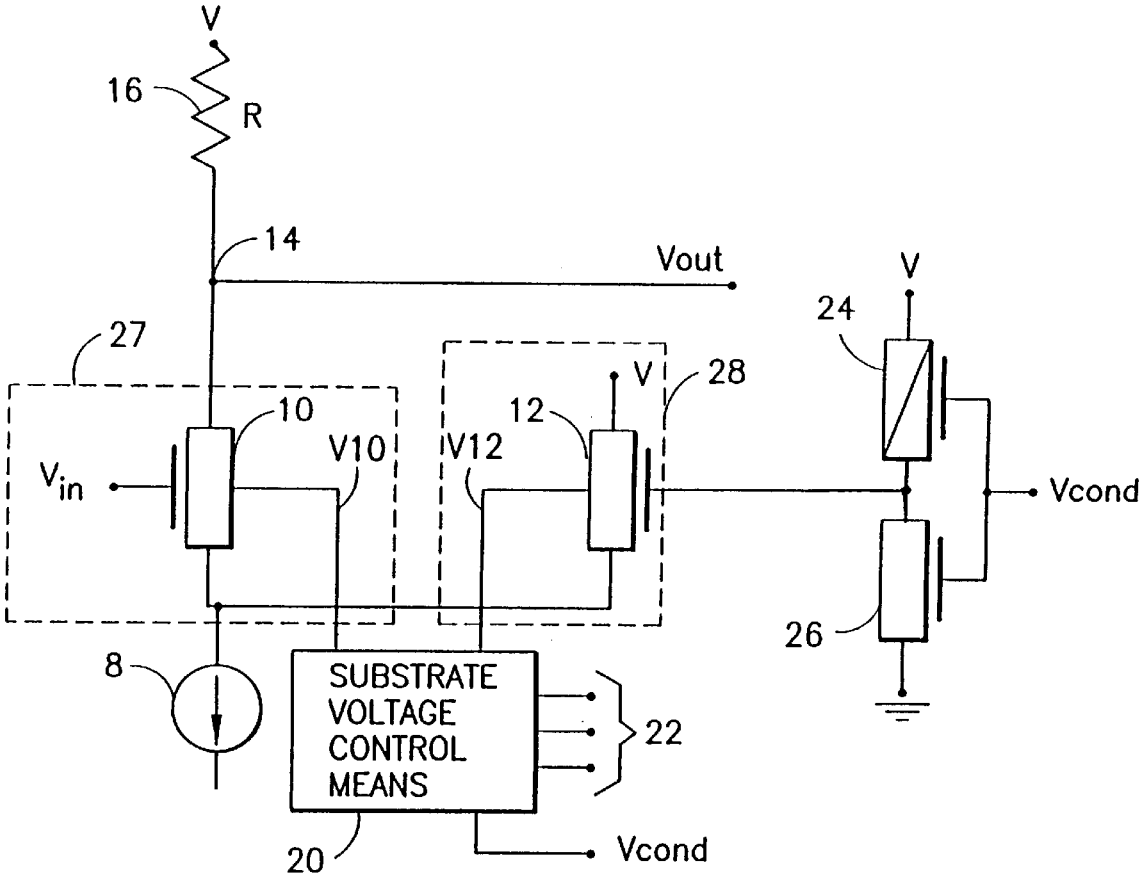
FIG. 5 is a schematic illustration of an embodiment of a circuit including a pair of transistors used to provide threshold voltage differences.

A still further method to obtain threshold differences is to apply different substrate (back side body) bias voltages to devices 10 and 12. Referring to FIG. 5, a substrate voltage control means 20 is shown connected to the body of devices 10 and 12 to provide substrate voltages V10 and V12 respectively. Separation of the backside bodies is required to perform the function as shown in FIG. 5. The elements 27 and 28 define an isolated body (.eg. NMOS in a P substrate in bulk silicon on insulator technology as taught in IBM Docket BU9-97-127. In silicon on insulator technology, the bodies are implicitly separated. Substrate voltage control means 20 is connected to reference setting inputs 22 and to a voltage input Vcond. As the substrate voltage of devices 10 and 12 are made more positive by applied voltages V10 and V12, their threshold voltages Vt10 and Vt12 are reduced. As the substrate voltage is made more negative, then the threshold voltage Vt10 and Vt12 increase. The voltage Vcond defines the voltage on the gate of transistor 12 by being applied to and controlling the gates of the transistors 24 and 26. If the voltage Vcond is zero, then transistor 24 is on, and the gate of transistor 12 is at voltage V. The reference setting inputs 22 supplied to substrate voltage control means 20 are used to define the magnitude of the substrate voltage V10 and V12 applied to transistors 10 and 12. Substrate voltage control means 20 contains analog-to digital converters that generate substrate voltages V10 and V12 that are applied respectively to transistors 10 and 12. The differential receiver input voltage Vin may be similar to those illustrated in FIG. 2 with a voltage swing between V and V—delta V, or may be similar to those illustrated in FIG. 3 with a voltage swing between 0 and delta V.

Figure 6:
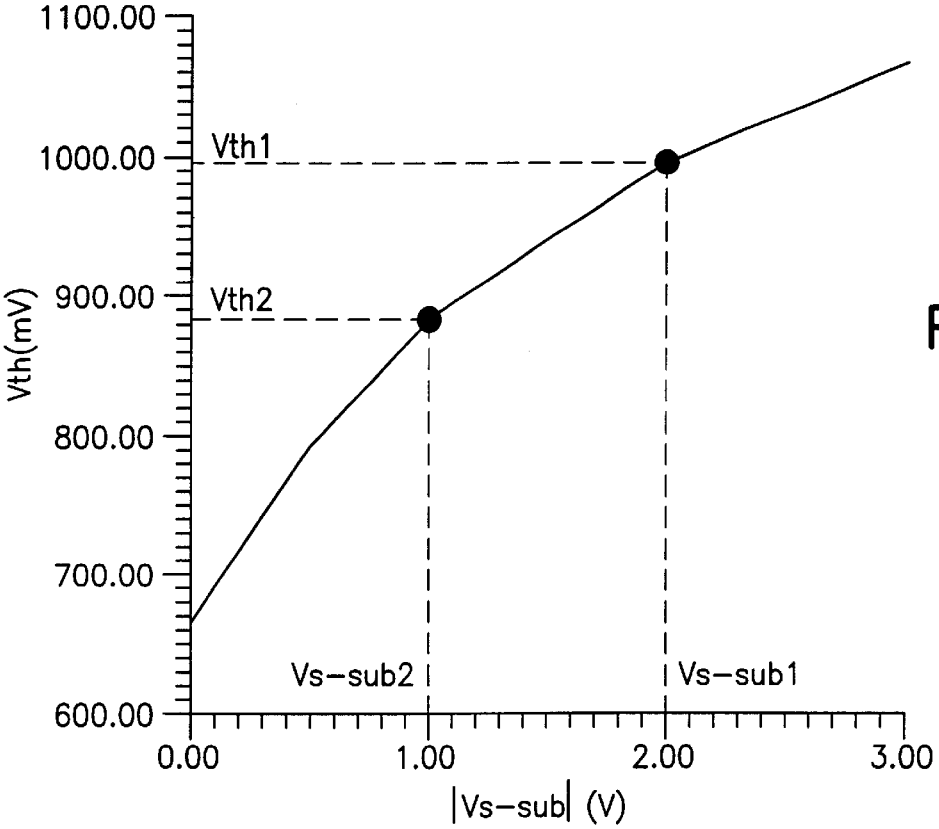
FIG. 6 is a graph illustration showing the relationship between threshold voltage Vth and [Vs-sub].

FIG. 6 is an illustration of how threshold voltage Vth increases with [Vs-sub].

Figure 7:
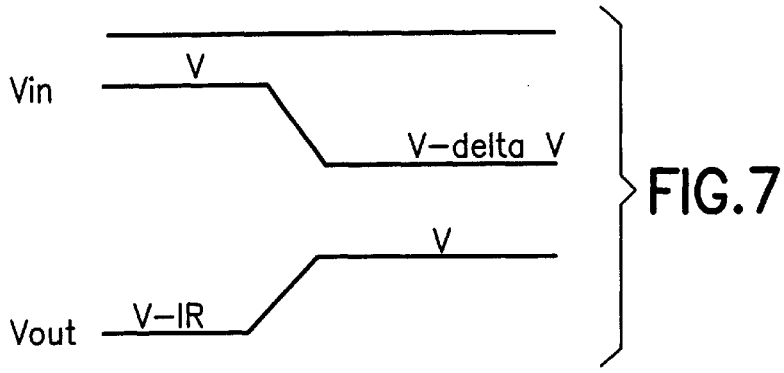
FIGS. 7 and 8 are schematic illustrations of waveforms for different operating modes of the present invention.

FIG. 7 shows the waveforms and conditions required for the embodiment of FIG. 5 for the mode when Vcond is zero. With Vcond=0, then transistor 24 is "on" and voltage V is applied to the gate of transistor 12. This condition is similar to that of FIGS. 1 and 2. As shown in FIG. 7, V10 is more positive than V12 so that Vt10 is less than Vt12. The reference level Vref=V−(Vt10−Vt12). The level Vt10−Vt12 is set by V10 and V12 from substrate control means 20. The output Vout swings from V—IR to V.

Figure 8:
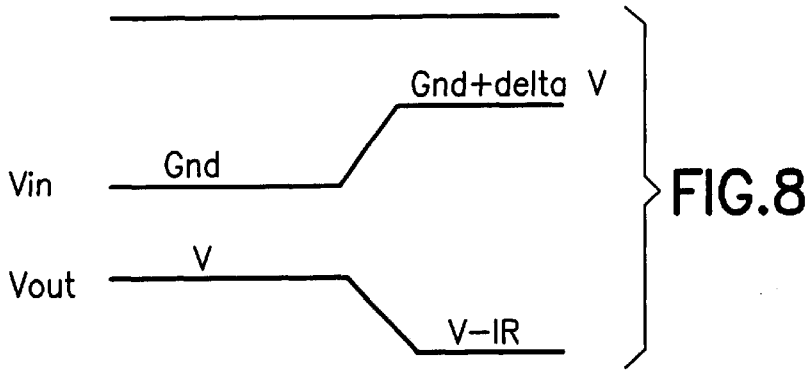

FIG. 8 illustrates the mode when Vcond=V. When Vcond=V, then transistor 26 is "on" and V=0 is applied to the gate of transistor 12. This condition is similar to that illustrated in FIGS. 2 and 3. Voltage V12 is more positive than V10 so that Vt12 is greater than Vt10. The reference level equals 0+Vt10−Vt12. The level Vt10−Vt12 is set by the output of substrate control means 20. The output Vout swings between V and V—IR.

Figure 9:
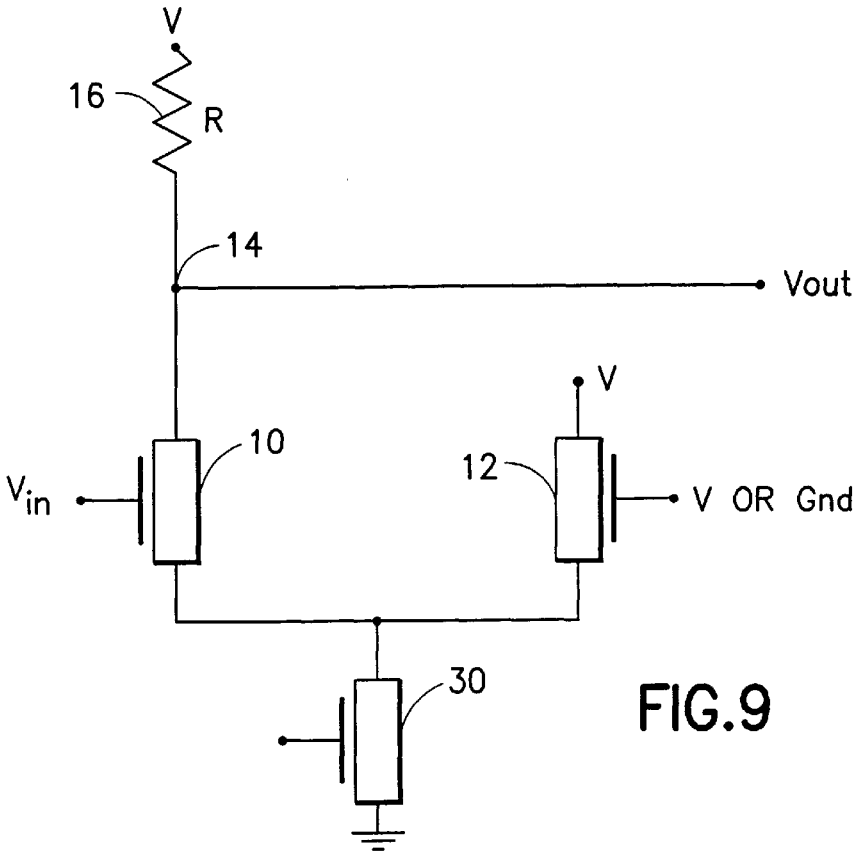
FIG. 9 is schematic illustration of the circuit of FIG. 1 modified by the static current source replaced by a clocked transistor.

The differential receiver embodiments illustrated in FIGS. 1 and 5 may be modified as shown in FIG. 9 with the current source 8 of the static receiver replaced with a transistor 30 which is clocked in synchronism with input signal Vin in order to reduce DC power dissipation.

Figure 10:
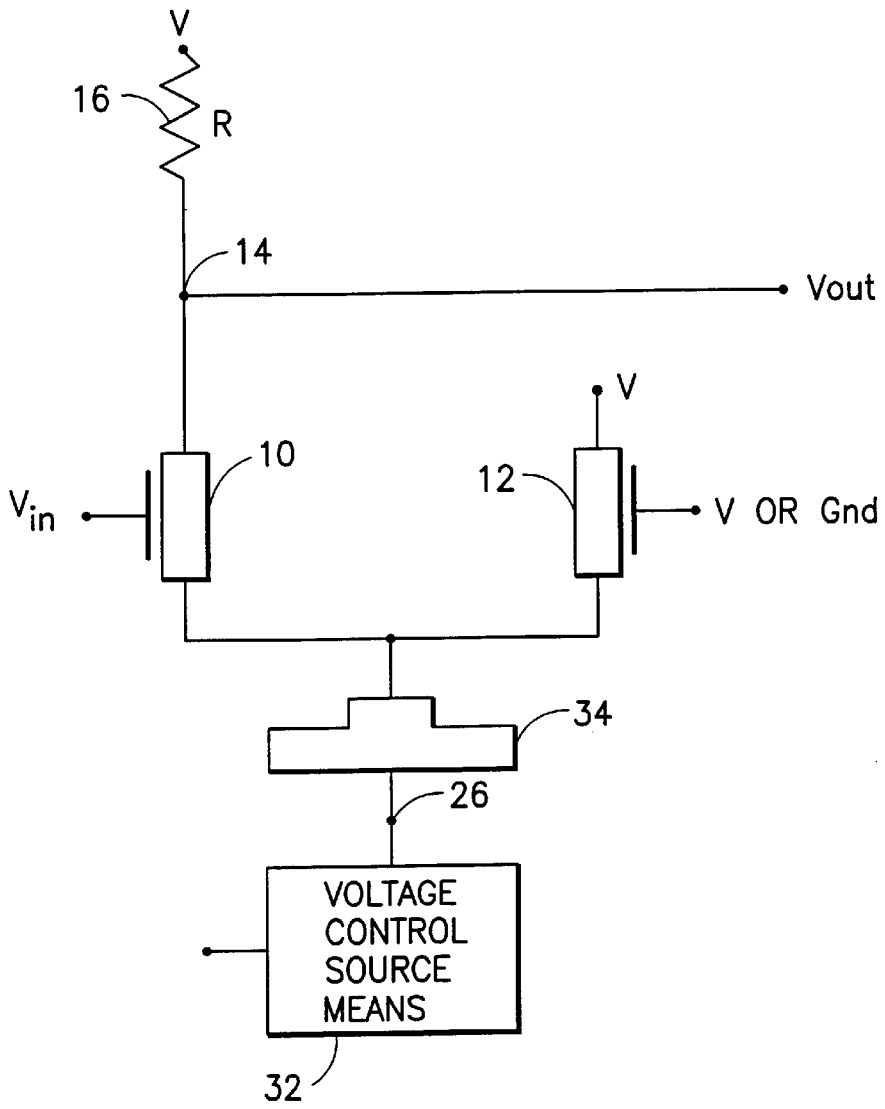
FIG. 10 is a schematic illustration of an embodiment of a receiver employing a voltage source and a capacitor instead of the current source used in the circuit of FIG. 1.
Figure 11:
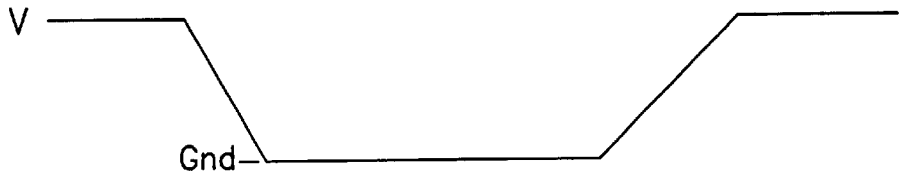
FIG. 11 shows the curves illustrating the voltage levels of the circuit of FIG. 10.

FIG. 10 shows a differential receiver embodiment with a voltage control source 32 and a capacitor 34 used instead of the current source employed in FIGS. 1 and 7 so that the receiver is controlled by the charge "Q" of capacitor 34. In FIG. 10 transistors 10 and 12 have different threshold voltages which may be obtained by any of the methods previously discussed. Node 26 between voltage control source 32 and capacitor 34 is maintained at a positive voltage V. As illustrated by the curve in FIG. 11, the voltage at node 26 is reduced to ground by voltage control source 32 to detect the incoming signal Vin, and is returned to voltage V in the quiescent state. The embodiment of FIG. 10 is suitable for very low power operation.

What has been described is a single-ended differential receiver for sensing small voltage swings that does not require the on chip generation of, or an external supply of a reference voltage to all the receivers in an integrated circuit array. The receiver of the present invention uses a built in reference voltage obtained by the difference in the threshold voltages of a pair of transistors. Several embodiments of the way to obtain the threshold difference voltage have been disclosed.

While the invention has been described in connection with a preferred embodiment, it is not intended to limit the scope of the invention to the particular form set forth, but on the contrary, it is intended to cover such alternatives, modifications and equivalence as may be included within the spirit and scope of the invention as defined in the appended claims.

What is claimed is:

1. A semiconductor receiver having a built in reference voltage provided by a threshold voltage difference comprising:

a substrate;

a circuit disposed on the substrate for receiving input signals and generating an output signal, said circuit including first and second transistors disposed on said substrate, said first transistor being connected to an input signal and wherein one side of each of said first and second transistors are connected together in common to a current source, and each having a different value of threshold voltage to produce a built in reference voltage that is a function of the difference in said voltage values of said first and second transistor threshold voltages, said receiving circuit further including a voltage control means connected to the substrates of said first and second transistors for adjusting the threshold voltage of the first and second transistors to be at different values, thereby adjusting the value of the reference voltage Vref, said receiving circuit further including a pair of third and fourth transistors connected to the gate of said second transistor to selectively apply a voltage level V to the gate of the second transistor, said third and fourth transistors being responsive to a Vcond voltage to define the level of the voltage V applied to the gate of said second transistors.

* * * * *